US009528797B2

(12) United States Patent
Harwood et al.

(10) Patent No.: US 9,528,797 B2
(45) Date of Patent: Dec. 27, 2016

(54) ANTI-BALLISTIC BARRIER COMPRISING FURNITURE

(71) Applicant: SECURESCAN GLOBAL PTY LTD, Mulgrave, Victoria (AU)

(72) Inventors: Craig Harwood, Mulgrave (AU); John Orr Campbell, Mulgrave (AU)

(73) Assignee: DFENCE SOLUTIONS PTY LTD, Melbourne, Victoria (AU)

( * ) Notice: Subject to any disclaimer, the term of this patent is extended or adjusted under 35 U.S.C. 154(b) by 0 days.

(21) Appl. No.: 14/770,166

(22) PCT Filed: Jan. 31, 2014

(86) PCT No.: PCT/AU2014/000067

§ 371 (c)(1),
(2) Date: Aug. 25, 2015

(87) PCT Pub. No.: WO2014/127400

PCT Pub. Date: Aug. 28, 2014

(65) Prior Publication Data

US 2016/0003583 A1 Jan. 7, 2016

(30) Foreign Application Priority Data

Feb. 25, 2013 (AU) ..... 2013900669
Sep. 18, 2013 (AU) ..... 2013903597

(51) Int. Cl.
*F41H 5/08* (2006.01)
*A47B 81/00* (2006.01)
(Continued)

(52) U.S. Cl.
CPC ..... *F41H 5/08* (2013.01); *A47B 55/00* (2013.01); *A47B 81/00* (2013.01); *A47B 91/00* (2013.01);
(Continued)

(58) Field of Classification Search
CPC ..... F41H 5/08; F41H 5/06; F41H 5/14; F41H 5/24; A47B 81/00; A47B 91/00; A47B 97/00
(Continued)

(56) References Cited

U.S. PATENT DOCUMENTS 5,176,437 A * 1/1993 Remington ..... A47B 91/08 248/500
6,170,379 B1 1/2001 Taylor
(Continued)

FOREIGN PATENT DOCUMENTS

CN 202567327 U 12/2012
WO WO 2012/018986 A1 2/2012
WO WO 2012/052587 A1 4/2012

OTHER PUBLICATIONS

International Search Report for corresponding International Patent Application No. PCT/AU2014/000067 mailed Apr. 11, 2014.
(Continued)

*Primary Examiner* — Joshua Freeman
(74) *Attorney, Agent, or Firm* — Merchant & Gould P.C.

(57) ABSTRACT

An anti-ballistic barrier comprising at least one furniture unit including: a top; a base; an anti-ballistic arrangement including an anti-ballistic material, the anti-ballistic arrangement having at least a portion extending between the top, and the base; and a mobility arrangement which, in use, enables each furniture unit to be moved between at least two positions, comprising a utility position, in which each furniture unit can be used in its typical furniture usage, and a defense position, in which each furniture unit can be used as a barrier to obstruct an opening such as a doorway, a passageway, a window or a service opening.

19 Claims, 10 Drawing Sheets

(51) Int. Cl.

| | |
|---|---|
| ***A47B 91/00*** | (2006.01) |
| ***A47B 97/00*** | (2006.01) |
| ***F41H 5/06*** | (2006.01) |
| ***F41H 5/14*** | (2006.01) |
| ***A47B 55/00*** | (2006.01) |

(52) U.S. Cl.
CPC ..... *A47B 97/00* (2013.01); *F41H 5/06* (2013.01); *F41H 5/14* (2013.01)

(58) Field of Classification Search
USPC ..... 89/36.09, 36.07, 36.04, 36.05
See application file for complete search history.

(56) References Cited

U.S. PATENT DOCUMENTS 6,588,705 B1 7/2003 Frank
6,622,607 B1 9/2003 Miller
6,817,687 B1 11/2004 Neeld et al.
6,907,811 B2 * 6/2005 White ..... F41H 5/14 109/49.5
D627,394 S * 11/2010 Nakayama ..... D19/114
7,849,781 B2 12/2010 White
7,891,283 B2 * 2/2011 Kleniatis ..... F41H 5/08 89/36.09
8,015,910 B1 * 9/2011 Fuqua ..... F41H 5/14 89/36.01
8,528,864 B2 * 9/2013 Villanueva Montero ..... B64D 45/00 244/129.1
8,701,544 B2 * 4/2014 Peters ..... F41H 5/06 89/36.01
8,726,782 B2 * 5/2014 White ..... F41H 5/14 89/36.09
8,850,949 B1 * 10/2014 Lopez ..... F41H 5/24 109/49.5
9,010,254 B1 * 4/2015 Kyler ..... E06B 7/28 108/6
9,188,411 B2 * 11/2015 Jacobsen ..... F41H 5/06
2003/0213359 A1 * 11/2003 Kropf ..... F41H 7/02 89/36.09
2004/0174105 A1 9/2004 Hung
2006/0138915 A1 6/2006 Goldberg
2007/0108807 A1 * 5/2007 Crossley ..... A47C 3/12 297/184.1
2010/0011950 A1 * 1/2010 White ..... F41H 5/14 89/36.09
2010/0096959 A1 * 4/2010 Weaver ..... A47B 19/02 312/109
2010/0303603 A1 * 12/2010 Galante ..... A47B 97/00 414/811
2010/0327639 A1 * 12/2010 Peters ..... A47C 7/00 297/183.1
2011/0005377 A1 * 1/2011 White ..... F41H 5/06 89/36.01
2011/0011255 A1 * 1/2011 Kleniatis ..... F41H 5/08 89/36.09
2012/0152096 A1 * 6/2012 Peters ..... F41H 5/06 89/36.01
2012/0174768 A1 * 7/2012 Spransy ..... F41H 5/013 89/36.09
2012/0247313 A1 * 10/2012 Peters ..... A47C 3/04 89/36.02
2012/0279134 A1 11/2012 Battenfield
2013/0119201 A1 * 5/2013 Villanueva Montero ..... B64D 45/00 244/129.1
2013/0333550 A1 * 12/2013 Jacobsen ..... F41H 5/06 89/36.09
2014/0084646 A1 * 3/2014 Benden ..... F41H 5/08 297/217.1
2014/0199678 A1 * 7/2014 Tunis ..... F41H 5/08 434/408
2015/0013922 A1 * 1/2015 Pegrum ..... E04B 2/7422 160/351
2015/0033990 A1 * 2/2015 Yeager ..... F41H 5/08 108/15
2015/0096471 A1 * 4/2015 Kyler ..... E06B 7/28 108/15
2015/0143985 A1 * 5/2015 Wemhoener ..... F41H 5/0471 89/36.02
2015/0153143 A1 * 6/2015 Hollenbach ..... F41H 5/06 89/36.01

OTHER PUBLICATIONS

Presidential Bulletproof Podium, Part No. LEC9050-NCH-BLU [retrieved on Mar. 14, 2014], Retrieved from internet: https://web.archive.org/web/20130121202353/http://www.lecternsandpodiums.com/Presidential-Bulletproof-Podium_p_180.html, published on Jan. 21, 2013 per Wayback Machine.

* cited by examiner

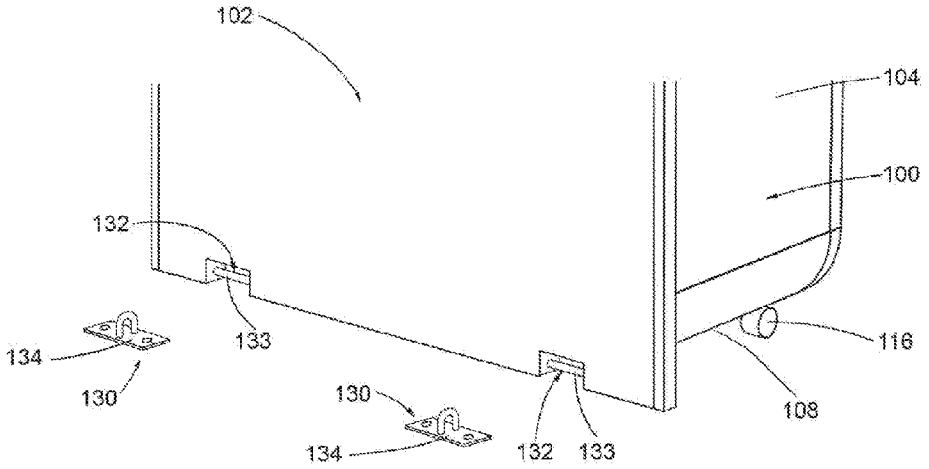
Figure 4
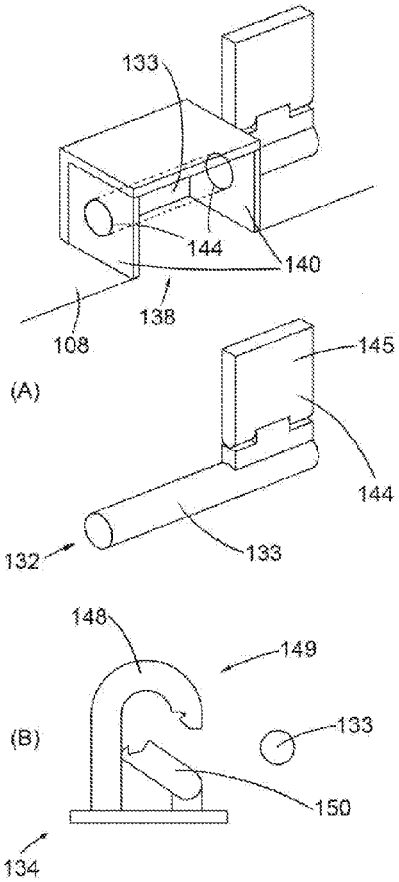
igure 5
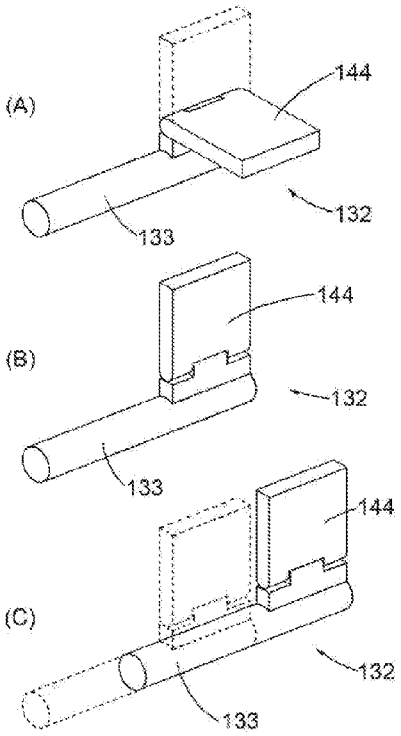
Figure 6

ANTI-BALLISTIC BARRIER COMPRISING FURNITURE

CROSS-REFERENCE

This application is a National Stage Application of PCT/AU2014/000067, filed 31 Jan. 2014, which claims benefit of Australian provisional patent applications No. 2013900669 filed on 25 Feb. 2013 and No. 2013903597 filed on 18 Sep. 2013, and which applications are incorporated herein by reference. To the extent appropriate, a claim of priority is made to each of the above disclosed applications.

TECHNICAL FIELD

The present invention generally relates to an anti-ballistic barrier taking the form of at least one furniture unit, and more particularly a barrier and/or shield that is bullet-proof and/or bullet resistant in nature and designed to be moved in front of or over an opening. The invention is particularly applicable for dual use as a piece of office furniture such as a presentation board or storage unit, for example shelving or a cupboard, and an anti-ballistic barrier for a doorway or window and it will be convenient to hereinafter disclose the invention in relation to that exemplary application. However, it is to be appreciated that the invention is not limited to that application and could be used in a large variety of anti-ballistic barrier and/or shielding applications.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

There is a growing need for self-protection aids, and more particularly bullet protection aids in a wide variety of locations. Whilst still infrequent in many countries, gun crimes and attacks are increasingly targeting civilians, typically at urban communal locations such as schools, universities, churches and community centres. Personal shields such as bullet resistant vests can provide suitable protection for an individual for selected applications. However, such anti-ballistic clothing is impractical and expensive for long term and large scale everyday use.

Additional means of protection could assist in reducing the number of fatalities of gun crimes in urban communal locations such as meeting rooms, classrooms, libraries, cafeterias, governmental chambers, council rooms, school board chambers. In such locations, a shielding device would ideally be designed to be used and blend into a conventional room's appearance so as to not detract or substantially alter the décor or character of that room.

International Patent Publication WO 2012018986 describes a method of retrofitting furniture to act as a ballistic shield and furniture constructed to provide a ballistic shield. In this patent publication, furniture such as tables, lecterns, desks, cupboards and chairs are taught as having one or more anti-ballistic panels or sheets incorporated into a side, surface or component thereof to provide bullet-proof and/or bullet-resistant properties. The anti-ballistic material preferably comprises a soft armour and a hard armour material component affixed to the interior and/or exterior surfaces of furniture allowing the flexibility or expansion required for maximum protection. In use, the furniture, for example a workplace table or lectern may be held in place or moved in place between the shooter and potential target victims to act as a bullet resistant shield.

U.S. Pat. No. 6,170,379 B1 describes a desk having a removable bullet resistant desk top shield which can be removed and used as a personal shield. The desk is described as used for protection against personal assault in school or as shield against projectiles such bullets, knives, shrapnel, or flying debris that might be encountered during earthquake, fires, and storms.

The anti-ballistic furniture of WO 2012018986 and U.S. Pat. No. 6,170,379 B1 are taught as only being used as a personal shield for a user, largely in their normal function and position when acting as a shield. The taught furniture would not provide a useful barrier for a large number of people, or be practical for use as a barrier to bar entry to a room or other enclosure.

It would therefore be desirable to provide an anti-ballistic barrier which could be integrated into a domestic or commercial room and provide a barrier to bar entry to a room or other enclosure.

SUMMARY OF THE INVENTION

The present invention provides an anti-ballistic barrier comprising at least one furniture unit including:

a top;

a base; and an anti-ballistic arrangement including an antiballistic material, the anti-ballistic arrangement having at least a portion extending between the top and the base; and a mobility arrangement which, in use, enables each furniture unit to be moved between at least two positions, comprising a utility position, in which each furniture unit can be used in its typical furniture usage, and a defence position, in which each furniture unit can be used as a barrier.

The anti-ballistic barrier of the present invention therefore provides a furniture unit which can be used for furniture of objects and items when in the utility position, and which can be used as an anti-ballistic barrier or shield when moved to a defence position. The anti-ballistic barrier blends into the décor and character of a room through its appearance and use a furniture unit. When necessary, each furniture unit can be used to shield a number of occupants of a room or enclosure from bullets or other ballistic objects.

It should be understood that the anti-ballistic barrier of the present invention can provide protection from ballistic material comprising projectiles including but not limited to bullets, knives, shrapnel, or flying debris that might be encountered in naturally occurring events such as earthquakes, fires, and storms.

The furniture unit can comprise any unit of furniture conventionally used in a room. In some embodiments, the furniture unit comprises a piece of office furniture, in particular a presentation board or a storage unit. Suitable presentation boards include whiteboards, blackboards or chalkboards, corkboards, screens or the like. It should be appreciated that the presentation board could also further include further elements such as one or more shelves, drawer, cupboard or the like. Suitable storage units include a shelving unit, a cupboard, a wardrobe, a drawer unit (such as a chest of draws) or the like. In preferred embodiments, the furniture unit comprises a storage unit which includes at least one shelf element on which objects can be stored within the storage unit. Each shelf element is preferably held between at least two side elements which extend between the top and the base. However, it should be appreciated that the shelf could be attached within the furniture unit via a number of arrangements. Furthermore, it should be appreciated that any number of shelf panels can be included in each storage unit. In some embodiments, the storage unit comprises two or more shelf panels located between at least two spaced apart side elements. In some embodiments, the storage unit may include one or more door elements. In some embodiments, the storage unit may include a hanger rail. In some embodiments, the storage unit may include one or more drawers.

The typical furniture usage of each furniture unit depends on the design and form of the furniture unit used in the antiballistic barrier. For example, where the furniture unit comprises a storage unit, such as a shelving unit, cupboard, wardrobe, drawer unit or the like, the typical furniture usage would be for storage. Where the furniture unit comprises a presentation board, such as a blackboard, whiteboard, corkboard or the like, the typical furniture usage would be as a presentation board on which indicia, images or objects can be drawn, projected or attached.

Whilst the anti-ballistic barrier can be used as a freestanding shield, it is preferred that one or more furniture units of the anti-ballistic barrier are used to substantially obstruct an opening when in the defensive position. The opening may comprises any entrance, aperture or gap which leads into a room or enclosure such as a doorway, passageway, window, service opening or the like. The anti-ballistic barrier can therefore shield a number of occupants of a room or enclosure from bullets or other ballistic objects that may enter or otherwise be shot into that room or enclosure through that opening. The anti-ballistic barrier also obstructs the opening, obstructing a person, such as a shooter, from entering that room or enclosure.

The furniture unit is preferably sized to form an obstruction for a doorway. For a single doorway, each furniture unit is preferably at least 1500 mm in height, preferably at least 2000 mm in height. Similarly, the anti-ballistic barrier is preferably at least 900 mm wide, preferably at least 1000 mm wide, more preferably at least 1300 mm wide, yet more preferably at least 1500 mm wide. However, it should be appreciated that the height and width can be selected to suit any sized opening, and could therefore vary from the above specified dimension whilst falling within the spirit and scope of the present invention. For example, double doorways would require an antiballistic barrier of at least 1800 mm wide, preferably at least 2000 mm wide. As noted below, embodiments of the anti-ballistic barrier of the present invention may comprise two or more furniture units in order to provide a practical and movable arrangement.

The furniture unit or units are designed to be movable between at least two positions. Movement of each furniture unit can be achieve using any number of suitable arrangements including wheel assemblies, rail assemblies, articulated arms, pulley systems or the like. In some embodiments, the mobility arrangement comprises a ground engaging arrangement connected to and/or extending from the base. Preferably, the ground engagement arrangement comprises at least one wheel, and more preferably at least two wheels.

In some embodiments, the ground engagement arrangement comprises a wheel assembly including at least four space apart wheels. The wheels enable a user to push each furniture unit between the utility and defence position and any other desired position or location. At least one of the wheels preferably includes a locking device which prevents rotation of the wheel. In some embodiments, the locking device can prevent rotation of each of the wheels, for example through the use of a central locking arrangement. In some embodiments, the central locking arrangement is operated by an actuator movable from a furniture position where the actuator is retracted within a portion of the furniture unit and an actuate position where the actuator extends to a position which a user can actuate, and more preferably manually manipulate. The locking device can therefore be used to assist in preventing unintentional movement of each furniture unit when in a selected position. Where the furniture unit includes at least four wheels, including at least a rear pair proximate to the back element and at least a front pair distal from the back element, it is preferred that at least one of the front pair of wheels is lockable.

The ground engagement arrangement can further include a stabilisation arrangement positioned to prevent tipping of the furniture unit. The stabilisation arrangement is generally positioned away from the center of mass of the furniture unit, preferably along or parallel with the back or front side of the furniture unit. In some embodiments, the stabilisation arrangement includes at least one stabilisation wheel, preferably comprising a multidirectional wheel. In some embodiments, the multidirectional wheel comprises a wheel which include rotating elements rotatable about two or more rotation axis, each rotation axis being angularly offset from each other. The rotation axes are preferably angularly offset by about 90 degrees.

In some embodiments, each furniture unit also includes at least two spaced apart side elements, the side elements extending between the top and the base. Where side elements are provided, the anti-ballistic arrangement is preferably configured having at least a portion extending between the top, the base and each side element of the furniture unit.

Each furniture unit can further include one or more handles to assist movement between the utility position and defensive position. The handle(s) can have any suitable form, and be attached at any suitable location on the furniture unit. In those embodiments including side elements, one or more handle can be formed in or attached to at least one of the side elements. In other embodiments, one or more handles can be formed in a front panel, rear panel, top panel or a combination thereof of the furniture unit. Each handle can be separately formed body or element which is attached to the furniture unit, for example a side element, or may be integrally formed in a panel (for example a side element) or other component of the furniture unit, for example as an aperture or recess.

It can be advantageous to further include a base fastening arrangement for securing the furniture unit into position in one or both of the utility position or the defensive position. Various arrangements are possible. In one embodiment, the base fastening arrangement comprises at least one latch which is releasably engageable with a receiving formation mounted in a fixed position in one or both of the utility position or the defensive position. The latch is preferably located in the base of the furniture unit and the receiving formation is fixed to a ground location in the utility position and/or the defensive position. In one form, the latch comprises a rod movable between a locking position in which the rod can be fastened into the receiving formation and an open position where the rod can be released from the receiving formation. The receiving formation preferably comprises a hook, loop, opening, aperture, channel, groove or body into which a rod can be received and fastened. More preferably, the receiving formation comprises a floor fastened or mounted bracket. In some embodiments, the bracket includes a clip portion, which enables a portion of the latch to be clipped into and securely received within the bracket.

It is desirable for each furniture unit to be stable and difficult to knock over or topple when being used as a barrier in the defence position. Some embodiments therefore further include at least one stabilisation component located near the base of each furniture unit. Each stabilisation component is movable between a furniture position in which the stabilisation component is substantially aligned with the base of the furniture unit and a stabilisation position, where the stabilisation shelf panel is in a ground engaging position extending outwardly from the base of the furniture unit. The stabilisation component can comprise a shelf panel, kickboard element, base panel, step element or the like connected to, and extendable from, the furniture unit. The stabilisation component stays connected to the furniture unit in the ground engaging position. This allows weights, such as books, objects or in some cases one or more persons to be placed onto the stabilisation shelf panel and thereby act as a weighted stabilisation arm for the base of the respective furniture unit.

Some embodiments may additionally or alternatively include at least one, preferably two, stabilisation arms movable from a furniture position within the furniture unit to a stabilisation position in which each arm extends between the shelf and a ground engaging position spaced away from the base. The stabilisation arms preferably comprise rods or poles, and more preferably foldable or telescopic arms which be rapidly deployed to provide additional stabilisation and/or support to prevent the furniture unit from being pushed or otherwise toppled over. Each arm preferably includes a slide resistant ground engaging foot, for example a rubber cap. The stabilisation arms are intended to extend from a mid-location of the respective furniture unit, for example from the middle of a side element of a furniture unit, and extend to the ground, to form a stabilisation prop between a ground location and the mid-location that the stabilisation arm is fixed to that furniture unit. For example, in one embodiment the stabilisation arms comprise fold down emergency poles with rubber slide resistant feet (end caps), extending from each side of the furniture unit. Each emergency pole is, mounted approximately halfway up each side element on rotating secure points.

The anti-ballistic barrier can include any number of furniture units. In some embodiments, a single furniture unit may be used, designed to obstruct a single doorway when in the defence position. In other embodiments, two or more furniture units may be used. For example, two or more furniture units may be necessary to obstruct a double doorway or wide doorway. Furthermore, furniture units of large dimension may be too difficult to move between the utility and defence position. It may be advantageous to use multiple smaller sized furniture units in order to minimize the weight of individual furniture units.

Where two or more furniture units are used, these furniture units may be positioned adjoining or spaced apart in relation to an opening the furniture units are used in conjunction. For example, in the utility position, each of the at least two furniture units can be located on laterally opposite sides of an opening. Alternatively, in the utility position, each of the at least two furniture units can be located on the same side of an opening. In each case, the furniture units would be moved across the opening to cooperative act as a barrier across that opening when moved into the defence position. Furthermore, each furniture unit would preferably include a furniture unit fastening arrangement to interconnect adjacent furniture units. The furniture unit fastening arrangement can take any suitable form, for example clips, latches, hooks, loops or the like. The furniture unit fastening arrangement is preferably located on one or both of the side elements of each furniture unit.

The top, base and side elements can have any suitable configuration. In a preferred embodiment, each of the top, base and/or the side elements comprises one or more panels.

Some embodiments further include a back element located between each of the top and base. In those embodiments that include side element, the back element is preferably located between each of the top, the base and the side elements. The back element preferably comprises a number of interconnected components, of which preferably includes the antiballistic arrangement. In some embodiments, the back element includes a rear compartment in which the antiballistic arrangement is housed. The back element can also include a back panel configured to provide an aesthetic outer cover over the back of the furniture unit and that back compartment. In other embodiments, the antiballistic arrangement can form part of a back panel of the furniture unit.

In some embodiments, the back element includes a recess configured to receive a door handle or other actuator. The recess can receive the door handle when the furniture unit is placed against a door thereby allowing the furniture unit to be placed flush against a locked interior door and any adjoining wall.

The antiballistic properties of each furniture unit are substantially provided by the antiballistic arrangement. The anti-ballistic arrangement includes at least one antiballistic panel substantially extending between the top, base and side elements. It should be appreciated, that the anti-ballistic arrangement can have smaller dimensions than the area bounded by the top, base and side elements or in other forms have larger dimensions that the area bounded by the top, base and side elements. The anti-ballistic arrangement functions to provide an anti-ballistic barrier within the area the top, base and side elements. In this respect, the anti-ballistic material of or in the antiballistic arrangement can form a barrier over at least part of the area extending between the top, base and side elements, and preferably substantially all of the area extending between the top, base and side elements. In some embodiments, parts of the antiballistic arrangement may extend past one or more of the top, base or side elements of the furniture unit. For example, the antiballistic arrangement may include an element which extends past the base of the furniture unit, to a position proximate or at a substantially ground engaging position. In such an embodiment, the anti-ballistic barrier preferably extends from a top of the furniture unit to a proximate ground engaging position in order to provide a solid sheet of anti-ballistic protection across the back of each furniture unit. Furthermore, in some embodiments, the anti-ballistic arrangement includes at least one antiballistic panel substantially extending parallel, preferably substantially adjacent to the side panels. Additionally or alternatively, other elements, such as the side elements, can also including anti-ballistic material. This can provide further anti-ballistic protection should any ballistic material penetrate the back element.

Any suitable anti-ballistic material can be used in the antiballistic barrier of the present invention. The anti-ballistic material can comprise at least one soft armour material, at least one hard armour material or a combination thereof. The anti-ballistic material is preferably selected to resist at least the shot of a .233 calibre, shotgun or handgun. Examples of preferred materials include but are not limited HHA Steels, UHA Steels, Aluminium, Ultra High Molecular Weight Polyethylene (UHMWPE), Aramid Fibre, Ceramics such as Silicon Carbide and Alumina Oxide, Ballistic Transparency (Glass/Polycarbonate), Hybrid UHMWPE/Aramid combination, Armorbond, Kevlar or combinations thereof.

In order to reduce the tipping potential of the furniture unit, the antiballistic arrangement is preferably centrally mounted on the mobility arrangement. More particularly, the mass of the antiballistic arrangement is preferably centrally distributed about the center of mobility arrangement.

BRIEF DESCRIPTION OF THE DRAWINGS

The present invention will now be described with reference to the figures of the accompanying drawings, which illustrate particular preferred embodiments of the present invention, wherein:

FIG. 4 is a partial rear perspective view of the anti-ballistic barrier shown in FIG. 1 illustrating a base fastening arrangement for securing each storage unit in place in the utility and/or defence position.

FIG. 5 is a perspective view of (A) a movable rod; and (B) floor bracket or the base fastening arrangement shown in FIG. 4.

FIG. 6 is a perspective view of the movement of the moveable rod shown in FIG. 5 moving between an open position and a locking position.

FIG. 7 provides a photograph of a front view of a fourth embodiment of the anti-ballistic barrier according to the present invention which includes a single storage unit.

DETAILED DESCRIPTION

Figure 1:
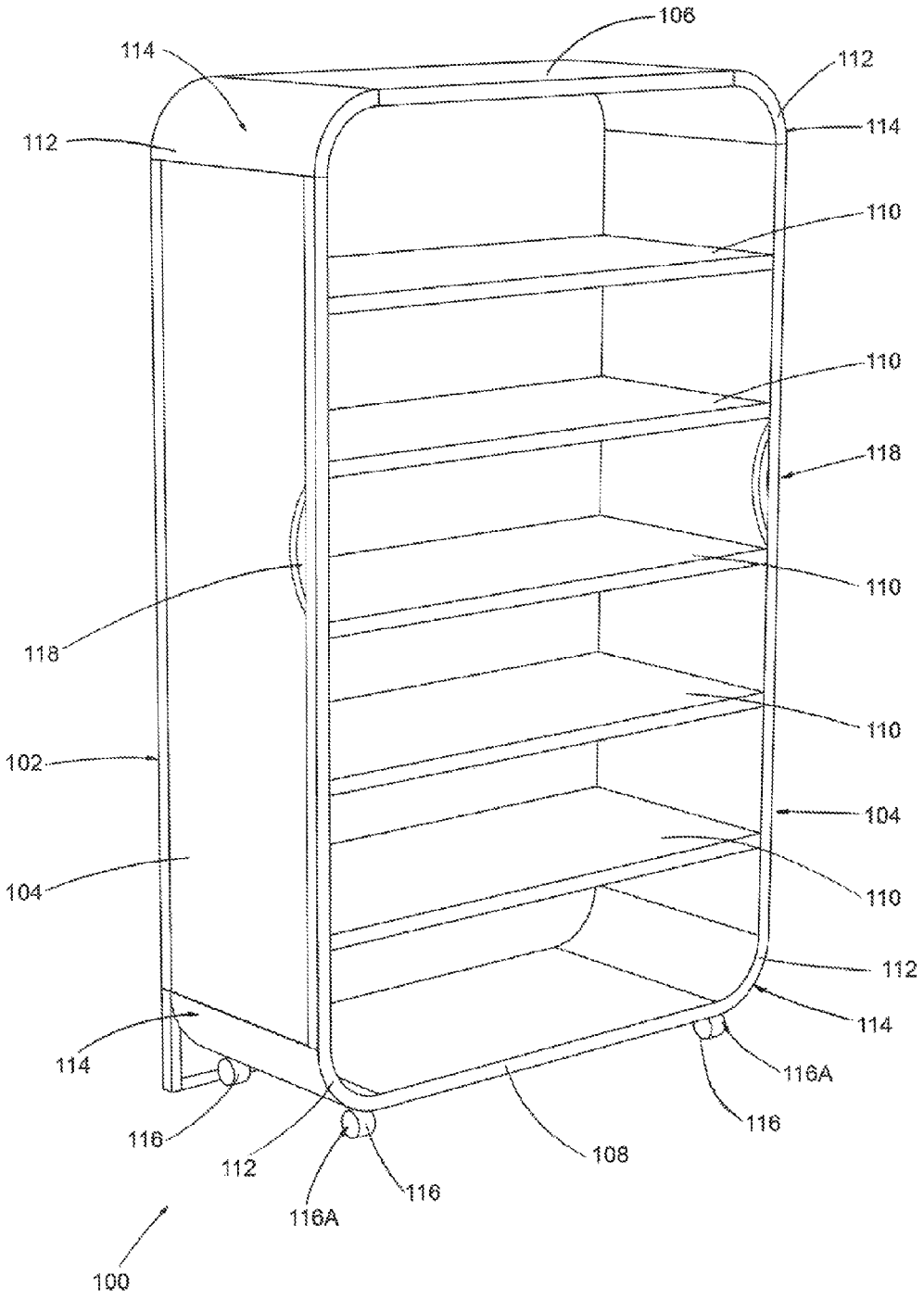
FIG. 1 is a perspective view of a first embodiment of the anti-ballistic barrier according to the present invention which includes a single storage unit.
Figure 2:
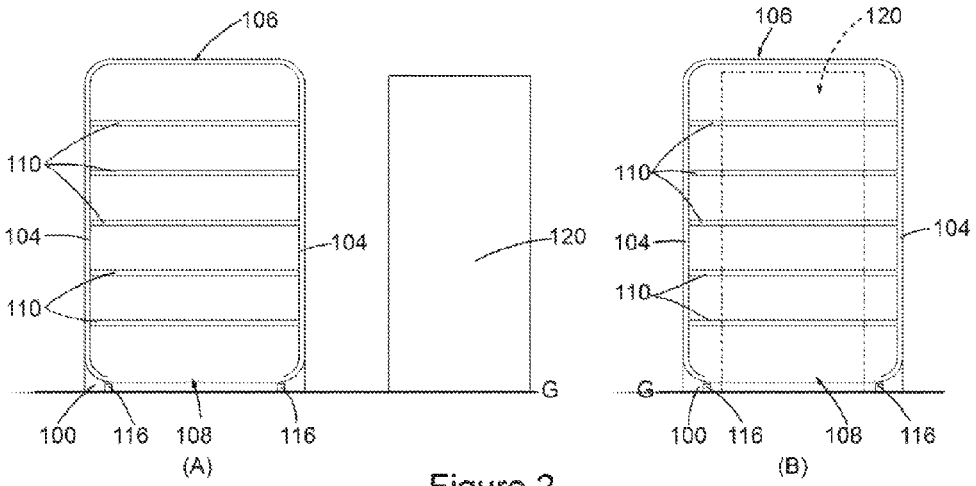
FIG. 2 is a front elevation view of the anti-ballistic barrier shown in FIG. 1 in (A) a utility position; and (B) a defence position obstructing a doorway.
Figure 3:
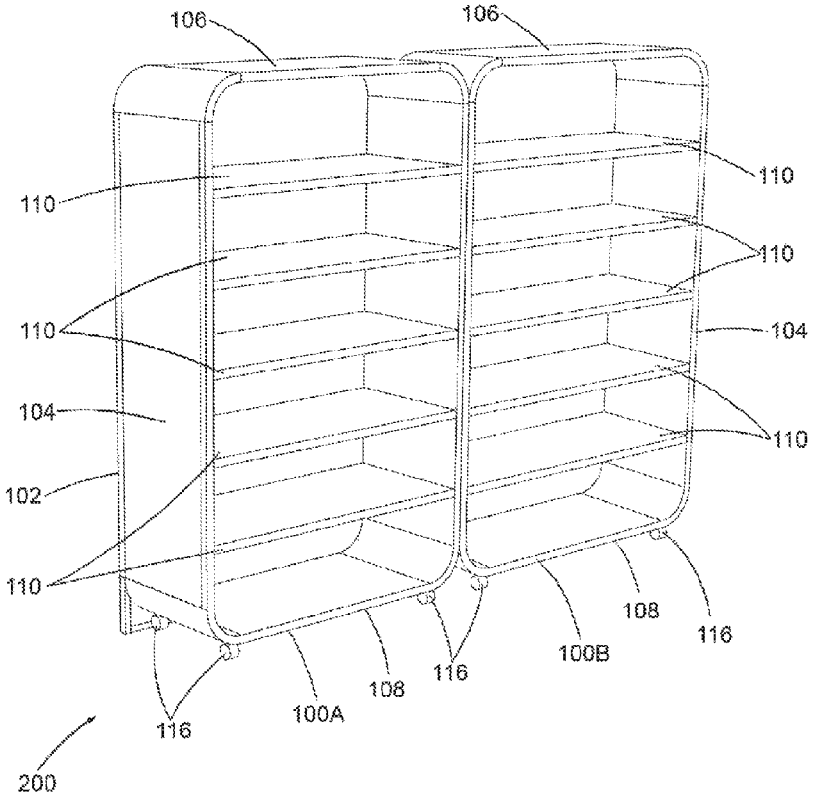
FIG. 3 is a perspective view of a second embodiment of the anti-ballistic barrier according to the present invention which includes two storage units.
Figure 7:
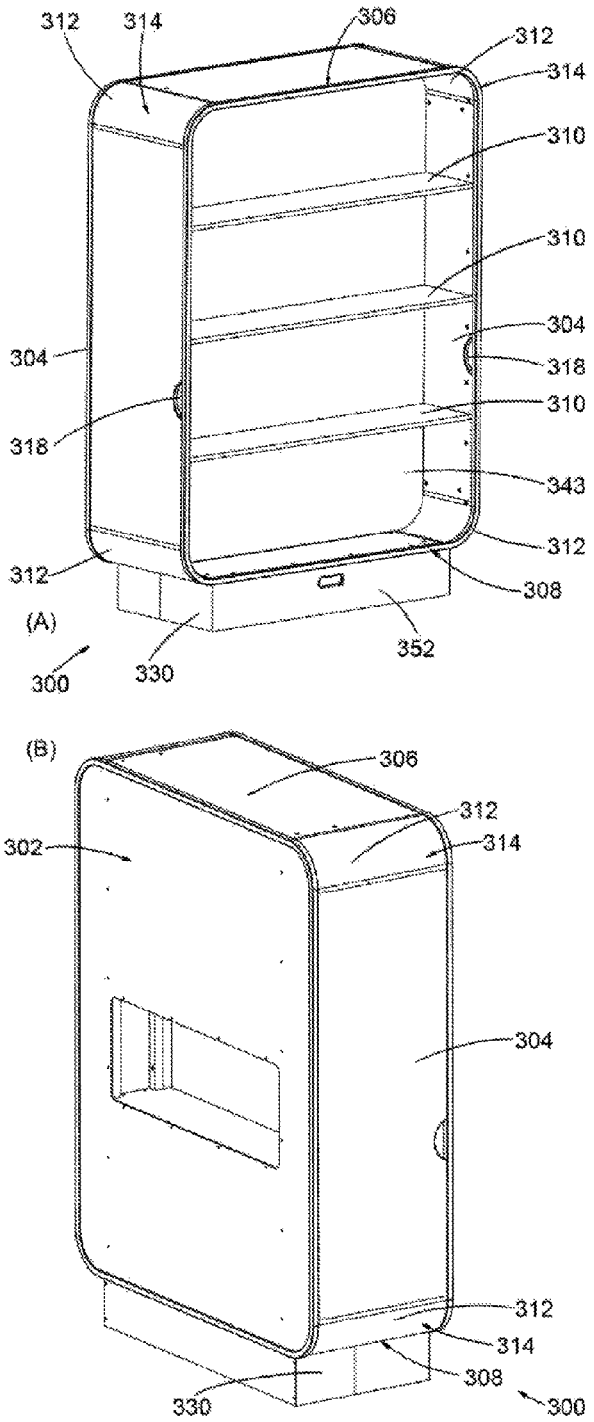
FIG. 7 provides a (A) front perspective view; and (B) rear perspective view, of a third embodiment of the anti-ballistic barrier according to the present invention which includes a single storage unit.
Figure 12:
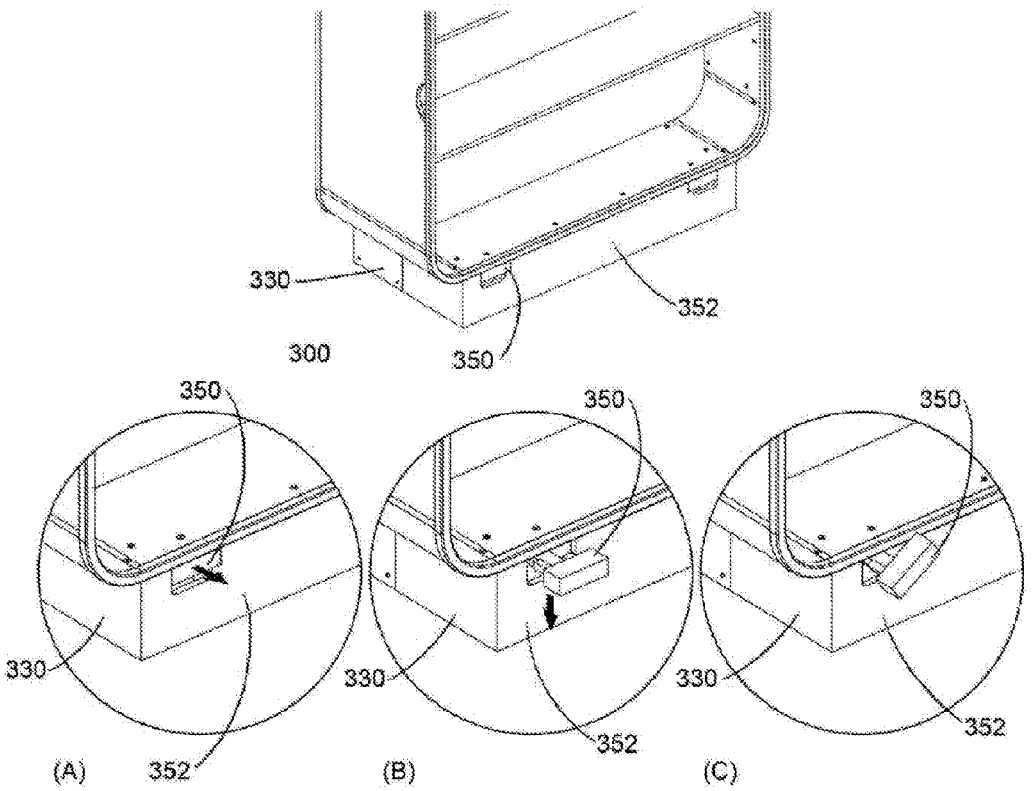
FIG. 12 provides a series of detailed perspective view of one form of actuator for the central locking assembly shown in FIG. 11.
Figure 13:
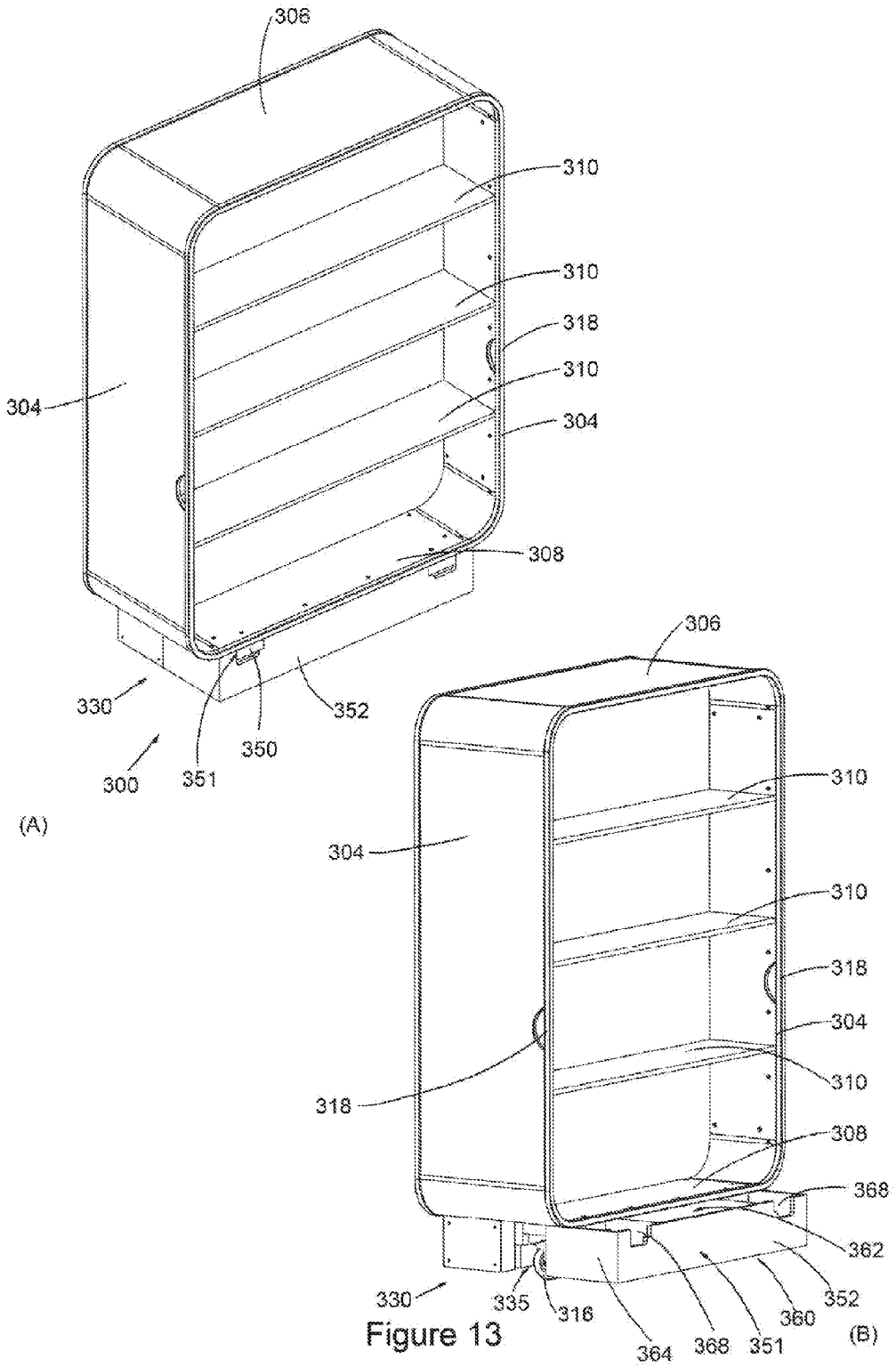
FIG. 13 provides side perspective views of the stabilisation kick board component used to stabilise the storage unit when in (A) a retracted position; and (B) an extended position.
Figure 14:
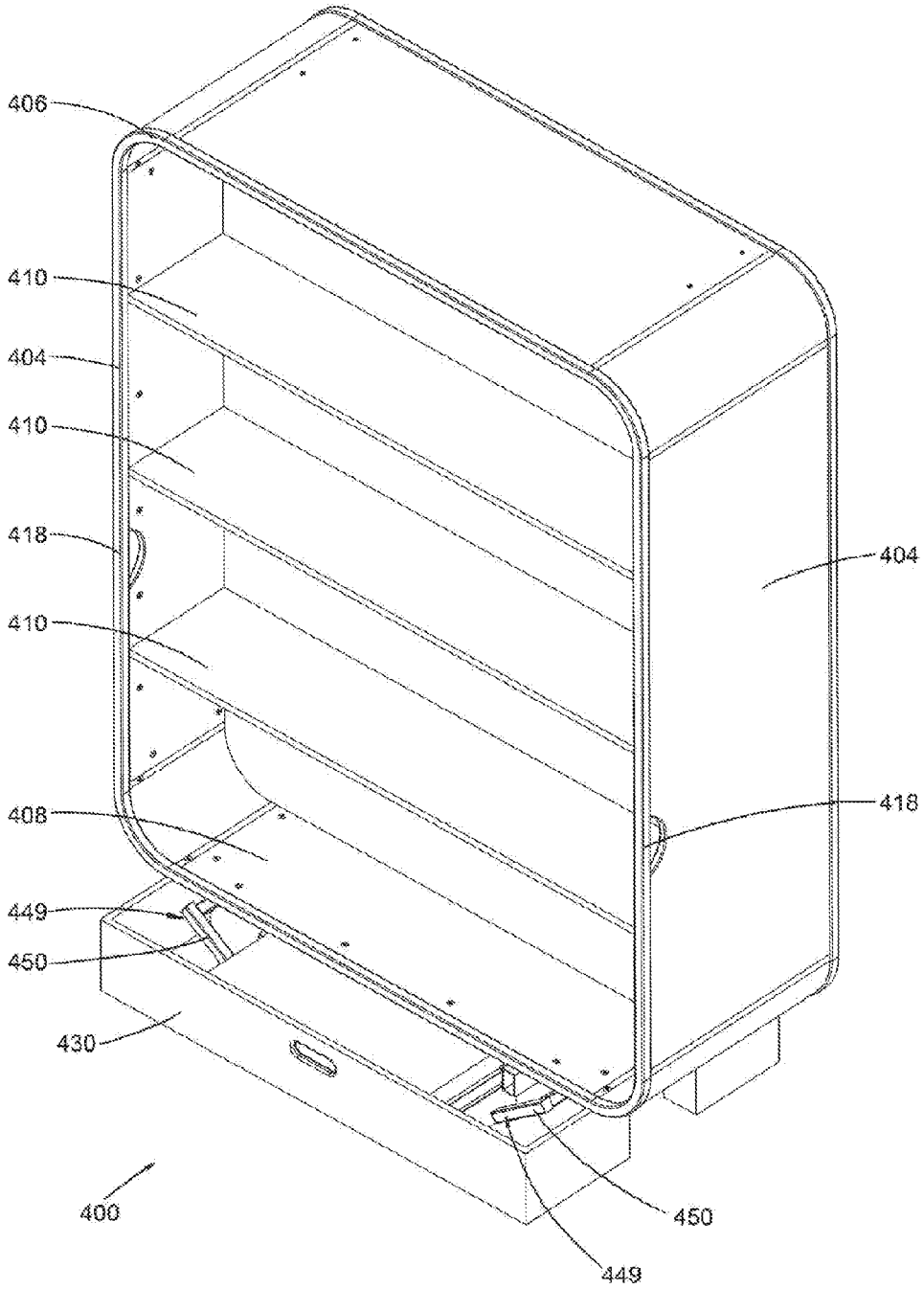
Figure 15:
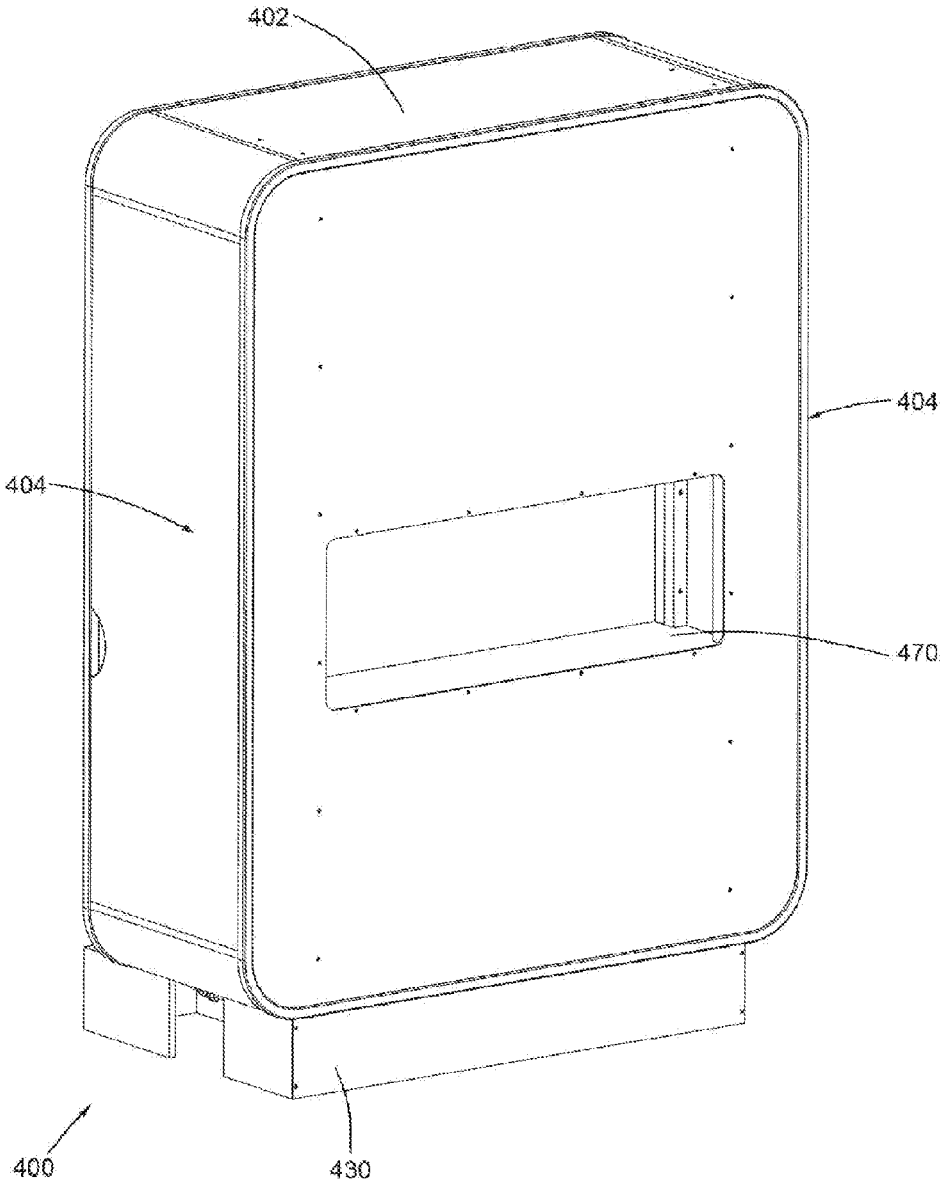
FIG. 15 provides a photograph of a rear perspective view, of the anti-ballistic barrier shown in FIG. 14.

The present invention provides an anti-ballistic barrier which includes a one or more movable furniture units having an anti-ballistic back element. FIGS. 1 and 2 illustrate a single furniture unit form 100 of the present invention. FIG. 3 illustrates a double furniture unit form 200 of the present invention. FIGS. 7 to 13 illustrate a second embodiment of a single furniture unit form 300 of the present invention. FIGS. 14 and 15 illustrate a third embodiment of a single furniture unit form 400 of the present invention. FIGS. 14 and 15 illustrate a fourth embodiment of a single furniture unit form 500 of the present invention.

Each of the embodiments shown in FIGS. 1, 2 and 3 have very similar configurations, and therefore the following description generally describes features of both these embodiments.

Firstly, referring to FIGS. 1 and 2, there is illustrated a single storage unit 100 that has the general configuration of a conventional shelving unit. It should however be appreciated that the unit could include one or more door panels (not illustrated), and therefore have the general configuration of a cupboard without departing from the spirit and scope of the present invention. Similarly, it should be understood that the storage unit 100 could include none, one, two or any number of shelves, depending on the items intended to be stored within the storage unit 100. For example, where clothes are intended to be stored, the storage unit 100 may include one or more hanger rails (not illustrated). Similarly, the storage unit 100 may include one or more drawers (not illustrated).

The illustrated storage unit 100 has a back panel 102, two spaced apart side panels 104, a top 106, base 108 and five spaced apart shelf panels 110 on which objects can be stored within the storage unit 100. Each of the shelf panels 110 extend and are fixed between the two side panels 104. The illustrated storage unit 100 includes rounded corners 112 and coloured inserts 114 at those corners to provide an ascetically designed unit. It should be appreciated that these and other features relate solely to the ascetics of the storage unit 100 and can be changed, varied, substituted, moved or removed without departing from the spirit or scope of the present invention.

The base 108 of the storage unit 100 include four caster wheels 116 which provide a mobility arrangement for the storage unit 100. The wheels 116 enable each storage unit 100 to be moved. Two handles 118, formed as arcuate apertures in each of the side panels 104, are provided as hand holds to assist a user's manual manipulation of the storage unit 100 when moving the storage unit 100. While not shown, at least one of the wheels 116, and preferably each of the front wheels 116A for ease of access, includes a locking device which prevents rotation of that wheel. The storage unit 100 can therefore be locked in a desired position by locking those wheels 116 in position. A number of suitable wheel locking arrangements including braking levers or the like are known in the art.

The antiballistic properties of the storage unit 100 are substantially provided by an antiballistic arrangement formed within the back panel 102. The back panel 100 extends from a top 106 of the storage unit 100 to a proximate ground engaging position in order to provide a solid sheet of anti-ballistic protection across the back of each storage unit 100. As shown in FIG. 1, the back panel 100 also substantially covers and shields the wheels 116 at the rear of the storage unit 100. Substantially all of the back panel 102 includes and/or is constructed from an anti-ballistic material. The remainder of the storage unit 100 is typically formed from other materials, such as wood, laminated wood, metal such as sheet metal, or the like. Nevertheless, other elements, such as the side elements 104, can also include anti-ballistic material in other embodiments.

Any suitable anti-ballistic material can be used in the antiballistic barrier of the present invention. The anti-ballistic material can comprise at least one soft armour material, at least one hard armour material or a combination thereof. In some embodiments, the anti-ballistic material comprises a combination of hard armour and soft armour materials. The anti-ballistic material is preferably selected to resist at least the shot of a 0.233 calibre, shotgun or handgun. Examples of possible anti-ballistic materials include EVLAR™, LEXAN™, KEVLAR™, SPECTRA SHIELD™, Armorbond™, carbon fiber composite materials, metal panels such as iron, steel, or titanium, or high impact polymer materials such as high impact resistant laminated polycarbonate plastic or combinations thereof. Further examples include HHA Steels, UHA Steels, Aluminium, Ultra High Molecular Weight Polyethylene (UHMWPE), Aramid Fibre, Ceramics such as Silicon Carbide and Alumina Oxide, Ballistic Transparency (Glass/Polycarbonate), Hybrid UHMWPE/Aramid combination and the like.

The anti-ballistic material may be used independently to form the back panel 102, or may be integrated into a composite or combination arrangement. For example, in one embodiment, the back panel 102 comprises a laminated wood exterior, and includes an internal laminated structure or other internal structure which includes the anti-ballistic material. This provides the external ascetics of a conventional storage unit 100 whilst providing an internal and/or hidden anti-ballistic shield in the back panel 102.

As best shown in FIG. 2, the storage unit 100 is designed to be moved between a utility position (FIG. 2A), and a defence position (FIG. 2B) using the wheels 116. The storage unit 100 is moved across the ground surface G using these wheels 116. In the utility position, the storage unit 100 is intended to be used for its conventional function of storage. The storage unit 100 therefore blends into the décor and character of a room, through its appearance and use a shelving unit (in the illustrated embodiment). The storage unit 100 is typically position to the side of a doorway 120 or other opening (for example a window) which the storage unit 100 is intended to obstruct. In the defence position, the storage unit 100 is intended to be positioned and used a barrier obstructing the selected opening 120. In FIG. 2, the selected opening is a doorway 120. The storage unit 100 is sized (height and width) to completely obstruct that doorway 120. When necessary, each storage unit 100 can be used to shield a number of occupants of a room or enclosure from bullets or other ballistic objects and/or obstructing a person, such as a shooter which would otherwise enter the room though the doorway 120.

The illustrated storage unit 100 is sized to form an obstruction for a standard single doorway. A standard doorway has dimensions of 91×203 cm (United States of America) or 84×198 cm (United Kingdom). The storage unit 100 is therefore preferably at least 200 cm in height and 100 cm wide, more preferably 210 cm high and 130 cm wide to fully obstruct the doorway. However, it should be appreciated that the height and width can be selected to suit any sized opening, and could therefore vary from the above specified dimension whilst falling within the spirit and scope of the present invention.

Larger openings, such as double doorways require a larger anti-ballistic barrier. It should be appreciated that storage units of large dimension, particular storage units full of storage items, may be too difficult to move between the utility and defence position. It can therefore be advantageous to use multiple smaller sized storage units in order to minimize the weight of individual storage units.

FIG. 3 illustrates a second embodiment, in which two storage units 100A and 100B are used to cooperatively obstruct a large doorway. The storage units 100A and 1008 have all the same features as the storage unit 100 illustrated in FIGS. 1 and 2, and it should be appreciated that the foregoing description equally applies to this embodiment 200. Again, the illustrated embodiments have the appearance of conventional shelving units. However, it should be appreciated that the unit could include one or more door panels (not illustrated), and therefore have the general configuration of a cupboard without departing from the spirit and scope of the present invention.

While not illustrated, it should be appreciated that the storage units 100A and 1008 may be positioned adjoining or spaced apart in relation to an opening the storage units are used in conjunction. For example, in the utility position, each of the at least two storage units 100A, 100B can be located on laterally opposite sides of an opening. Alternatively, in the utility position, each of the two storage units 100A and 100B can be located on the same side of an opening. In each case, the storage units 100A and 100B would be moved across the opening to cooperative act as a barrier across that opening when moved into the defence position.

Again, while not illustrated, each storage unit 100A and 100B can include a unit fastening arrangement to interconnect adjacent storage units. A number of suitable fastening arrangements are well known in the art. Each of the sides 104 could include a cooperating clip, latch, hook, loop or the like which lock two abutting sides of adjacent storage units 100A and 100B together, such as shown in FIG. 3.

FIGS. 4 to 6 illustrate one form of floor fastening arrangement 130 used to securing the storage unit 100 in position in one or both of the utility position or the defensive position. In preferred embodiments, the storage unit 100 is secured in position in the utility position.

As best shown in FIG. 4, the floor fastening arrangement 130 comprises two latch assemblies 132 comprising a movable pin 133 which is releasably engageable with floor bracket 134 mounted in a fixed position in one or both of the utility position or the defensive position. As best shown in FIG. 5(A), the latch assembly 132 comprises a movable pin 133, fitted into a recess 138 in the base 108 of the storage unit 100. The recess 138 includes a metal frame 140 including apertures 144 through which the movable pin 133 is received. The movable pin 133 includes a handle 144, which can include a warning notice 145 regarding replacement of the pin. The floor bracket 134 comprises a metal hoop 148 fixed into the floor, for example screwed or bolted into place.

As best shown in FIG. 6, the latch assembly 132 is movable between a closed position (FIG. 6(A)—handle 144 turned down for storage, and 6(B)—handle 144 turned up for actuation) in which the movable pin 133 is received in apertures 144 and an open position (FIG. 6(C)) in which the movable pin 133 is slid out of the apertures 144 and out from the hoop 148 of the floor bracket 134.

As best shown in FIG. 5(B), in some embodiments, the hoop 148 includes a clip portion 149 which includes a movable biased section 150, biased to a closed position, which can move inwardly to receive the movable pin 133 and then be biased closed to clip/lock the pin 133 in place. For initial placement of the storage unit 100 in the utility position, the latch 132 is placed in the closed position, and the latch 132 aligned with the floor brackets 134 and then pushed into place. The movable biased section 150 ensures that the pin 133 is received and locked into the hoop 148 of the floor bracket 134.

When the storage unit 100 is required to be move, for example to the defence position, the latch assembly 132 is moved from the closed to the open position, thereby releasing the pin 133 from the hoop 148 of the floor bracket 134.

While not illustrated, it should be appreciated that the storage unit 100 may include one or more stabilisation components which can be used to provide further stabilisation to the storage unit 100 to assist in the prevention of the storage unit 100 being knocked over or toppled when being used as a barrier in the defence position.

Now, referring to the single storage unit form 300 shown in FIGS. 7 to 13, it can be seen that the illustrated storage unit 300 has a similar external configuration as the storage unit 100 shown in FIGS. 1 and 2. Again, the storage unit 300 has the general configuration of a conventional shelving unit. Like the first embodiment, it should be appreciated that the storage unit 300 could include one or more door panels (not illustrated), and therefore have the general configuration of a cupboard without departing from the spirit and scope of the present invention. Similarly, it should be understood that the storage unit 300 could include none, one, two or any number of shelves, depending on the items intended to be stored within the storage unit 300. For example, where clothes are intended to be stored, the storage unit 300 may include one or more hanger rails (not illustrated). Similarly, the storage unit 300 may include one or more drawers (not illustrated).

The illustrated storage unit 300 has a back panel 302, two spaced apart side panels 304, a top 306, base 308 and three spaced apart shelf panels 310 on which objects can be stored within the storage unit 300. Each of the shelf panels 310 extend and are fixed between the two side panels 304. The illustrated storage unit 300 includes rounded corners 312 and coloured inserts 314 at those corners to provide an ascetically designed unit. It should be appreciated that these and other features relate solely to the ascetics of the unit 300 and can be changed, varied, substituted, moved or removed without departing from the spirit or scope of the present invention.

The storage unit 300 additionally includes a kickboard arrangement 330 which extends between the base 308 and ground level. The kickboard arrangement 330 provides a cover over a wheel assembly 335 (best shown in FIGS. 9 to 11), on which the storage unit 300 is mounted. As will be described in relation to FIG. 13, the kickboard arrangement 330 also provides a stabilisation arrangement.

Figure 9:
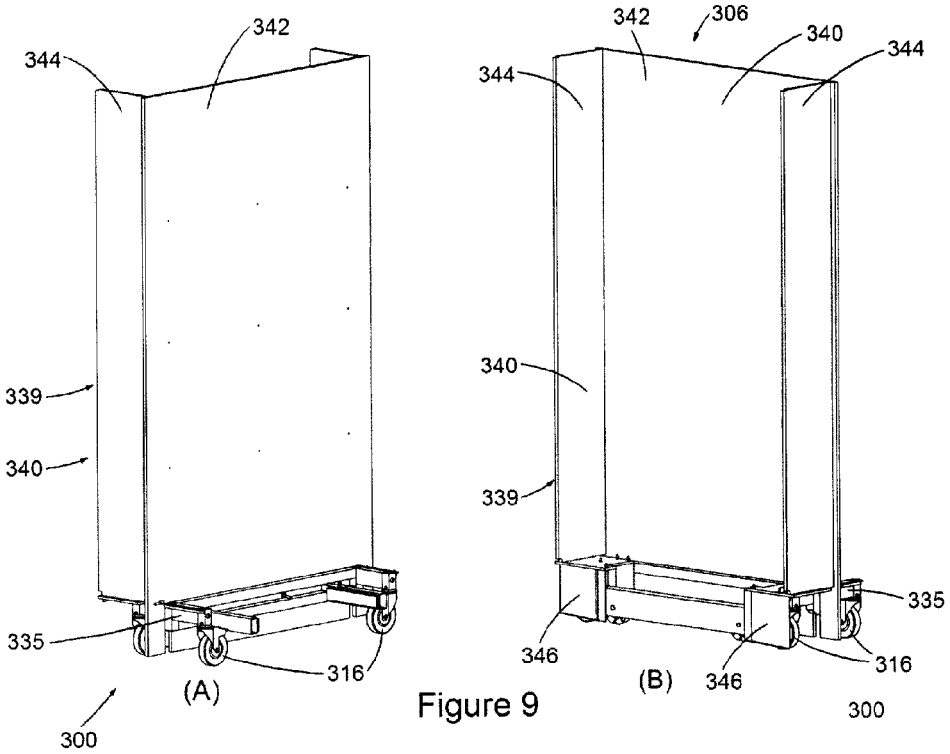
FIG. 9 provides a (A) front perspective view; and (B) rear perspective view, of the antiballistic arrangement of the storage unit shown in FIG. 7.

The outer structure of the storage unit 100 shown in FIG. 9 is typically formed from other materials, such as wood, laminated wood, metal such as sheet metal, or the like. Nevertheless, other elements, such as the side elements 304, back panel 104 or the like can also include anti-ballistic material in other embodiments.

Figure 8:
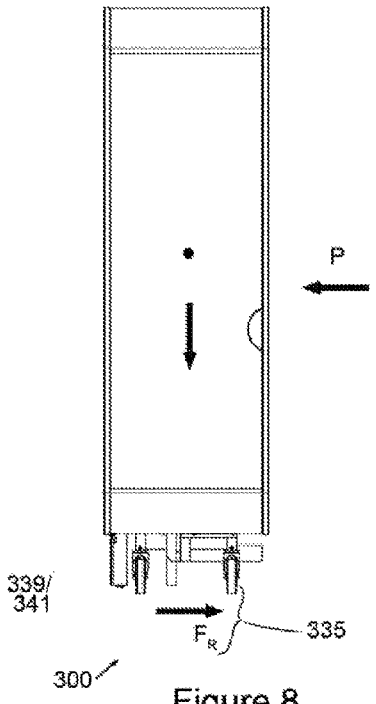
FIG. 8 provides a side elevation view of the storage unit shown in FIG. 7 showing the center of mass of the storage unit.

FIG. 8 provides a side elevation view of the storage unit 300 showing that the center of mass of the storage unit 300 is designed to be centred over the center of the storage unit 300 and over the center of the wheel assembly 335. This centre location of the mass of the storage unit 300 is intended to assist stabilisation of the storage unit 300, particularly against a tipping force (for example tipping force P shown in Figure P). As described below, stabilisation wheels 339 also assist with stabilisation.

As best shown in FIGS. 9(A) and 9(B), the antiballistic properties of the storage unit 300 are provided by an antiballistic arrangement 340 housed in a rear internal compartment 339 of the storage unit 300. In this embodiment, the antiballistic arrangement 340 comprises an insert component having a main antiballistic panel 342 providing back protection, which extends from the top 306 of the storage unit 300 to a proximate ground engaging position, and between the sides 304 of the storage unit 300 in order to provide a solid sheet of anti-ballistic protection through and across the back of each storage unit 100. The antiballistic arrangement 340 also includes two laterally extending antiballistic side panels 344, which provide side protection and two box inserts 346 which substantially covers and shields the wheels 316 of the wheel assembly 335 at the rear of the storage unit 300. Substantially all of the antiballistic arrangement 340 includes and/or is constructed from an anti-ballistic material, as previously described in relation to the first embodiment.

As shown in FIG. 9, the antiballistic arrangement 340 is centrally located within the storage unit 300, thereby substantially locating the mass of that component at the center of the storage unit 300. The back of the main antiballistic panel 342 lies on the back face 343 of the storage unit 300. A back panel 302 is used to conceal the rear internal compartment 339 housing the antiballistic arrangement 340, and provides an ascetically matching rear face for the storage unit 300.

Figure 10:
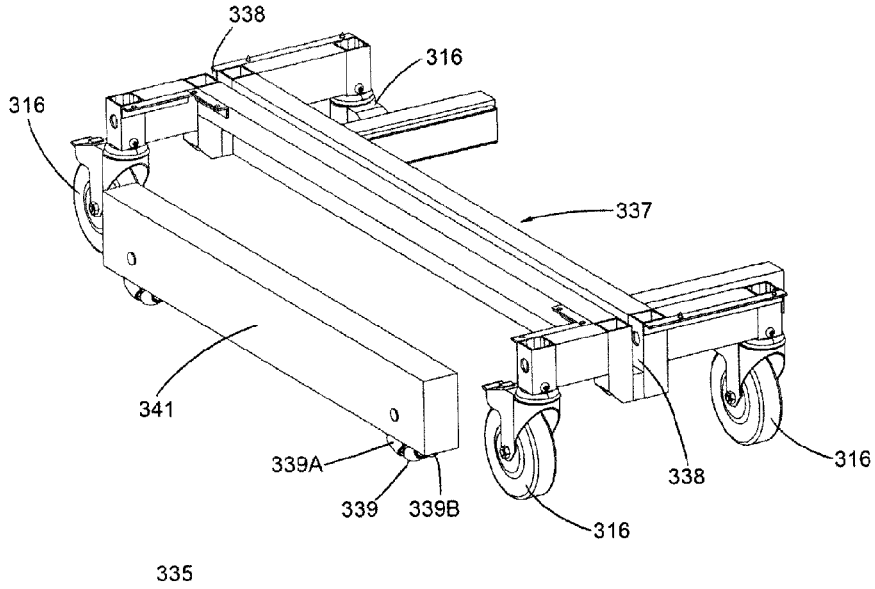
FIG. 10 provides a perspective view of the wheel assembly of the storage unit shown in FIG. 7.
Figure 11:
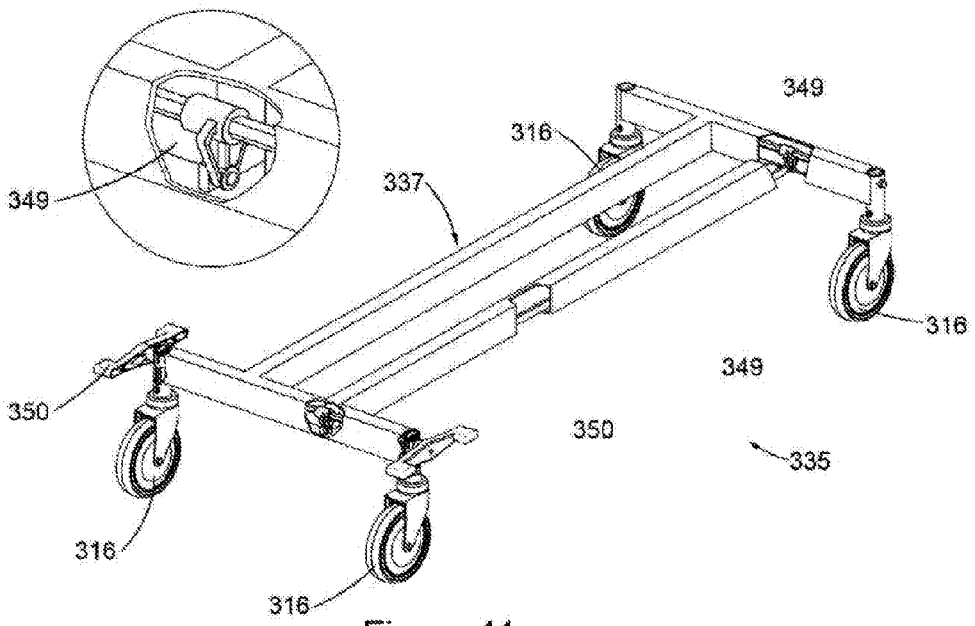
FIG. 11 provides a further perspective view of the wheel assembly shown in FIG. 7, focusing on the central locking assembly thereof.

As shown in FIGS. 9(A) and (B), the antiballistic arrangement 340 is seated on the wheel assembly 335. As best shown in FIGS. 10 and 11, the wheel assembly 335 comprises an I-shaped framework 337 including four caster wheels 316 which provide a ground engaging mobility arrangement for the storage unit 100. Each of the castor wheels 316 are able to rotate about the fixture point to the I-shaped framework 337 allowing freedom of movement of the wheel assembly 335 and the storage unit 300. As shown in FIG. 9, the antiballistic arrangement 340 is seated on and over the I-shaped framework 337 with the base section of the main antiballistic panel 342 being received within mounting recesses 338. The base 308 is also attached, or otherwise mounted to the I-shaped framework 337.

The wheel assembly 335 also includes stabilisation wheels 339 positioned to prevent tipping of the storage unit 300. In the illustrated embodiment, two stabilisation wheels 339 are held in an elongate mounting sleeve 341 in a position substantially along the back side of the storage unit 300. Each stabilisation wheel 339 comprises a multidirectional wheel comprising a main circular wheel 339A and a plurality of annularly spaced apart secondary wheels 339B located around the outer circumference of the main circular wheel 339A, having a rotation axis perpendicular to the main circular wheel 339A. The multi-directional nature of the stabilisation wheels 339 are intended to provide a movable pivot point/line.

As noted above, the kickboard arrangement 330 is used to conceal the wheel assembly 335.

Rotation of each of the wheels 316 can be locked using a central locking arrangement 346. As best shown in FIGS. 11 and 12, the I-shaped framework houses an internal actuation system 349 comprising an interconnected set of mechanical levers and rods, which interconnect the locking mechanisms on each wheel 316. An actuator 350 located proximate to one or more wheels 316 of the wheel assembly 335 can be used to centrally lock and unlock the wheels 316. As shown in FIG. 12, in some embodiments, the actuator 350 can be concealed within a recess/opening 351 in a front panel 352 of the kickboard arrangement 330. The actuator 350 is design to be moveable from a concealed position within the front panel 352 of the kickboard arrangement 352 (FIG. 12(A), and an extended position (FIGS. 12(B) and 12(C)) where a user can actuate (for example manually manipulate) the actuator 350, to the required lock and/or unlock positions. The storage unit 300 can therefore be locked in a desired position by locking those wheels 316 in position. Again, a number of suitable wheel locking arrangements including braking levers or the like are known in the art.

The wheel assembly 335 and associated wheels 316 enable each storage unit 300 to be moved. Two handles 318, formed as arcuate apertures in each of the side panels 304, are provided as hand holds to assist a user's manual manipulation of the storage unit 300 when moving the storage unit 300. While not illustrated, it should be appreciated that the storage unit 300 is designed to be moved between a utility position, and a defence position using the wheels 316 in a similar manner as is illustrated in FIGS. 2A and 2B for the first embodiment. Therefore, in the utility position, the storage unit 300 is intended to be used for its conventional function of storage. In the defence position, the storage unit 300 is intended to be positioned and used a barrier obstructing a selected opening, such as a doorway.

Similarly, the illustrated storage unit 300 is sized to form an obstruction for a standard single doorway as described above in relation to the first embodiment. It should be appreciated that the height and width can be selected to suit any sized opening, and could therefore vary from the above specified dimension whilst falling within the spirit and scope of the present invention. Similarly, as previously described in relation to the first embodiment, two or more storage units 300 can be used to cooperatively obstruct a large doorway.

As noted above, the kickboard arrangement 330 of the storage unit 300 further includes at least one stabilisation component located near the base 308 of the storage unit 300. As best shown in FIG. 13, the stabilisation component comprises a kickboard stabiliser 360 having the form of a box, having an upper panel 362 connected to the base 308 of the storage unit 300 and front 352 and side panels 364 which extend from the upper panel 352 to a ground engaging position. The kickboard stabiliser 360 is movable between a storage position in which the kickboard stabiliser 360 is located under the base 308 (FIG. 13(A)) of the storage unit 300 and a stabilisation position, where the kickboard stabiliser 360 is in a ground engaging position extending outwardly from the base 308 and connected to the storage unit 300 (FIG. 13(B)). In the stabilisation position, the kickboard stabiliser 360 provides greater ground engaging surface area away from the center of mass of the storage unit 300 to resist tipping. The upper panel 362 can also accommodate weights, such as books, objects or in some cases one or more people can be placed onto the stabilisation shelf panel and thereby act as a weighted stabilisation arm for the base of the respective storage unit 100. It should be noted that the upper panel 362 includes channels 368 which accommodate the central wheel lock actuator(s) 350 (as described above) when the kickboard stabiliser 360 is moved to the stabilisation position.

While not illustrated, it should be appreciated that the storage unit 300 may include one or more further stabilisation components which can be used to provide further stabilisation to the storage unit 300 to assist in the prevention of the storage unit 300 being knocked over or toppled when being used as a barrier in the defence position.

FIGS. 14 and 15 illustrate a further single storage unit form 400 of the antiballistic barrier of the present invention. The illustrated storage unit 400 has a similar configuration as the storage unit 300 shown in FIGS. 7 to 13. Like the storage unit 300, this storage unit 400 has the general configuration of a conventional shelving unit and has back panel 402, two spaced apart side panels 404, a top 406, base 408 and three spaced apart shelf panels 410 on which objects can be stored within the storage unit 400. Each of the shelf panels 410 extend and are fixed between the two side panels 404. The storage unit 400 additionally includes a kickboard arrangement 430 which extends between the base 408 and ground level. The kickboard arrangement 330 also provides a cover over a wheel assembly (not illustrated) on which the storage unit 400 is mounted and also provides a stabilisation arrangement.

It should be appreciated that this storage unit 400 embodiment has the same configuration and function as described in relation to the previous storage unit embodiment 300 and that the preceding description should be taken to equally apply to the storage unit 400 illustrated in FIGS. 14 and 15. The major differences between the storage unit 400 shown in FIGS. 14 and 15 and the storage unit 300 shown in FIGS. 7 to 13 are:

(1) The actuator 450 is located within kickboard arrangement 430 in the storage unit 400 rather than the concealed within a recess/opening 351 in a front panel 352 of the kickboard arrangement 330.

(2) The back panel 402 includes a recess 470 configured to receive a door handle or other actuator to allow the storage unit 400 to be placed against locked interior door flush against wall. The illustrated recess 470 comprises a rectangular cut out within the back panel 402 and is located at a typical door handle height and is sided to accommodate differing locations (height, width and door side) of a door handle on a door.

Again, while not illustrated, it should be appreciated that the storage unit 400 may include one or more further stabilisation components which can be used to provide further stabilisation to the storage unit 400 to assist in the prevention of the storage unit 400 being knocked over or toppled when being used as a barrier in the defence position.

Figure 16:
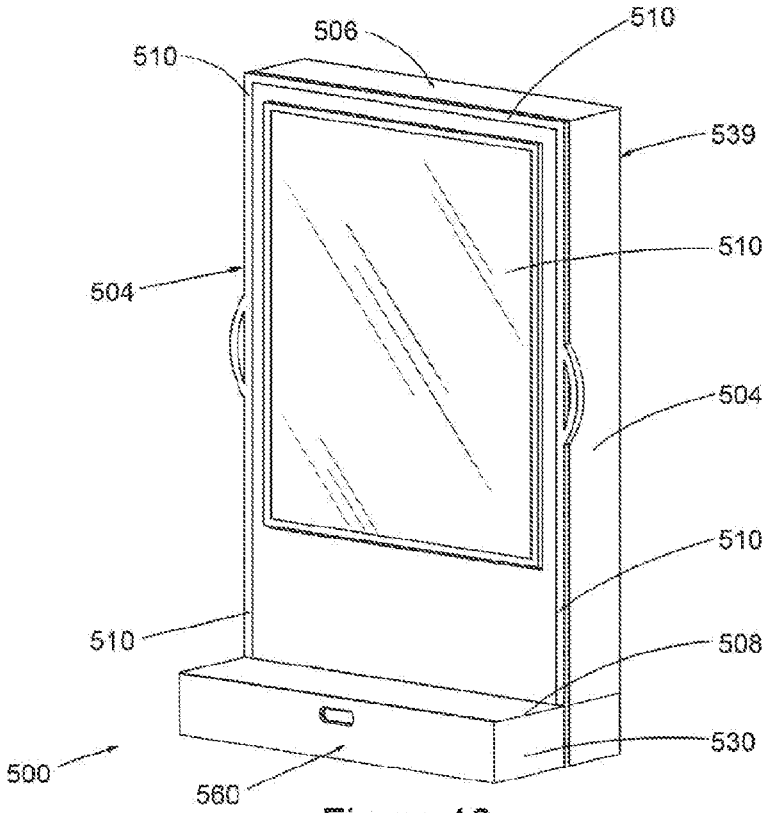
FIG. 16 is a front perspective view of a fifth embodiment of the anti-ballistic barrier according to the present invention which includes a single presentation board.
Figure 17:
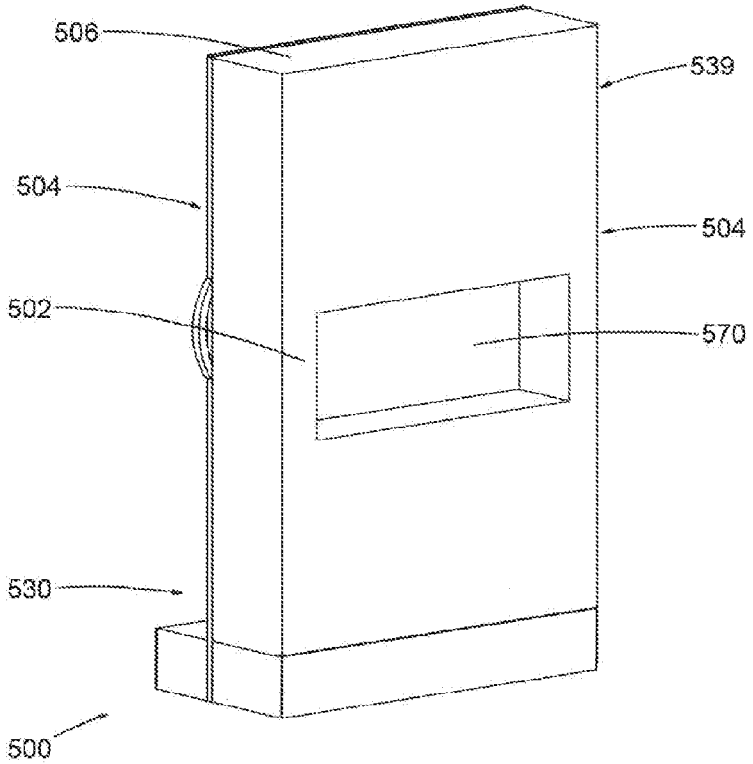
FIG. 17 is a rear perspective view of a fifth embodiment of the anti-ballistic barrier according to the present invention which includes a single presentation board.

FIGS. 16 and 17 illustrate a presentation board form 500 of the antiballistic barrier of the present invention. The illustrated presentation board 500 has a similar configuration as the storage units 400 shown in FIGS. 14 and 15. It should be appreciated that this presentation board 500 embodiment has the same configuration and function as described in relation to the previous storage unit embodiment 300 and 400 and that the preceding description should be taken to equally apply to the presentation board 500 illustrated in FIGS. 16 and 16.

In this respect, presentation board 500 has back panel 502, two spaced apart side panels 504, a top 506, and base 508. This structure is mounted on a similarly configured kickboard arrangement 530 which extends between the base 508 and ground level. The kickboard arrangement 530 provides a cover over a wheel assembly 335 (the same as FIGS. 9 to 11), on which the presentation board 500 is mounted. The kickboard arrangement 530 also provides a stabilisation arrangement as previously described in relation to storage units 300 and 400.

In the place of the shelf recesses of the storage unit, the presentation board 500 has a front presentation panel 510.

This panel 510 sits directly in front of the antiballistic arrangement 540. The front presentation panel 510 is affixed over the front side of the side panels 504, top 506, and base 508 to form a presentation surface. It should be appreciated that this presentation surface can be a board or panel such as a whiteboard, chalkboard, corkboard, pin board, projector screen or the like which a user can use to write, attach or project desired information for presentation. The illustrated presentation panel 510 includes rounded corners 512 to provide an ascetically designed unit. It should be appreciated that these and other features relate solely to the ascetics of the unit 500 and can be changed, varied, substituted, moved or removed without departing from the spirit or scope of the present invention. The front panel 510 also includes side handles 518 formed as recesses in the sides of the panel 510 to assist movement of the presentation board 500.

While not illustrated, it should be appreciated that the presentation board 500 could further include other elements such as one or more shelves, drawer, cupboard or the like. For example, in some embodiments, the It should be appreciated that the presentation board 500 further includes a shelf (not illustrated) below the presentation panel 510. This shelf could comprise a single shelf or multiple shelves between the base 508 and the lower edge of the presentation panel 510.

As with the previous embodiments, the center of mass of the presentation board 500 is designed to be centred over the center of the presentation board 500 and over the center of the wheel assembly (not illustrated) to assist stabilisation of the presentation board 500, particularly against a tipping force.

The antiballistic properties of the presentation board 500 are provided by the same antiballistic arrangement 340 as described and illustrated in relation to storage unit 300. In this embodiment, the antiballistic arrangement (not illustrated) is housed in a rear internal compartment 539 behind the presentation panel 510. Again, this unit includes a back panel 502 to conceal the rear internal compartment 539 housing the antiballistic arrangement, and provides an ascetically matching rear face for the storage unit 300. As shown in FIG. 17. The back panel 502 includes a recess 570 configured to receive a door handle or other actuator to allow the presentation board 500 to be placed against locked interior door flush against wall. The illustrated recess 570 comprises a rectangular cut out within the back panel 502 and is located at a typical door handle height and is sided to accommodate differing locations (height, width and door side) of a door handle on a door.

The antiballistic arrangement (not illustrated in FIGS. 16 and 17) is seated on a wheel assembly (not illustrated in FIGS. 16 and 17). This wheel assembly is the same as described and illustrated in relation to FIGS. 10 and 11. The wheel assembly of presentation board 500 also includes similar stabilisation wheels (not illustrated in FIGS. 16 and 17), comprising multidirectional wheels, positioned to prevent tipping of the presentation board 500 as described above. The kickboard arrangement 530 is used to conceal the wheel assembly. Again, rotation each of the wheels of the wheel assembly can be locked using a central locking arrangement similar to described and illustrated in relation to FIGS. 11 and 12.

The wheel assembly and associated wheels enable each presentation board 500 to be moved. While not illustrated, it should be appreciated that the presentation board 500 is designed to be moved between a utility position, and a defence position using the wheels. Therefore, in the utility position, the presentation board 500 is intended to be used for its conventional function for presentation (writing, pinning, projection or the like depending on the function of the presentation panel 510). In the defence position, presentation board 500 is intended to be positioned and used a barrier obstructing a selected opening, such as a doorway.

Similarly, the illustrated presentation board 500 is sized to form an obstruction for a standard single doorway as described above in relation to the first embodiment. It should be appreciated that the height and width can be selected to suit any sized opening, and could therefore vary from the above specified dimension whilst falling within the spirit and scope of the present invention. Similarly, as previously described in relation to the first embodiment, two or more presentation board 500 can be used to cooperatively obstruct a large doorway.

As noted above, the kickboard arrangement 530 of the presentation board 500 further includes at least one stabilisation component located near the base 508 of the presentation board 500 similar to the kickboard stabiliser 360 described and illustrated in relation to FIG. 13. Again, the kickboard stabiliser 560 has the form of a box, connected to the base 508 of the presentation board 500 which is movable between a storage position in which the kickboard stabiliser 560 is located under the base 508 of the presentation board 500 and a stabilisation position, where the kickboard stabiliser 560 is in a ground engaging position extending outwardly from the base 508 and connected to the presentation board 500.

While not illustrated, it should be appreciated that the presentation board 500 may include one or more further stabilisation components which can be used to provide further stabilisation to the presentation board 500 to assist in the prevention of the presentation board 500 being knocked over or toppled when being used as a barrier in the defence position.

For example, some embodiments may further include one or more stabilisation arms (not illustrated) movable from a storage position within the storage unit 100, 100A, 300, 400 or presentation board 500 to a stabilisation position in which each arm extends between the storage unit 100, 100A, 300, 400 or presentation board 500 and a ground G engaging position spaced away from the base 108, 308, 408 of the storage unit 100, 100A, 300, 400 or presentation board 500. For example, in one embodiment the stabilisation arms comprise fold down emergency poles with rubber slide resistant feet (end caps), extending from each side panel 104, 304, 404 of the storage unit 100, 100A, 300, 400 or presentation board 500. Each emergency pole is mounted approximately halfway up each side panel 104, 304, 404 on rotating secure points.

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. An anti-ballistic barrier comprising at least one furniture unit selected from at least one of a presentation board; or a storage unit including:

a top;

a base;

an anti-ballistic arrangement including an antiballistic material, the anti-ballistic arrangement having at least a portion extending between the top and the base;

a mobility arrangement which, in use, enables said at least one furniture unit to be moved between at least two positions, comprising a utility position, in which said at least one furniture unit can be used can be used in its typical furniture usage, and a defence position, in which said at least one furniture unit can be used as a barrier; and at least one stabilisation component located near the base of the furniture unit which is movable between a furniture position in which the stabilisation component is substantially aligned with the base of the furniture unit and a stabilisation position, where the stabilisation component is in a ground engaging position extending outwardly from the base of the furniture unit, wherein the stabilisation component comprises a base panel or step element connected to, and extendable from, the base of the furniture unit.

2. An anti-ballistic barrier according to claim 1, wherein in the defence position, said at least one furniture unit is used to substantially obstruct an opening comprising a doorway, passageway, window, or service opening.

3. An anti-ballistic barrier according to claim 1, wherein the mobility arrangement comprises a ground engaging arrangement extending from and/or connected to the base comprising a wheel assembly including at least four space apart wheels.

4. An anti-ballistic barrier according to claim 3, wherein at least one of the wheels include a locking device which prevents rotation of the wheel, preferably each wheel of the ground engagement arrangement.

5. An anti-ballistic barrier according to claim 3, wherein the ground engagement arrangement further includes a stabilisation arrangement positioned to prevent tipping of the furniture unit which includes at least one stabilisation wheel, preferably comprising one or more multi-directional wheels.

6. An anti-ballistic barrier according to claim 1, further including at least one handle to assist movement between the utility position and defence position.

7. An anti-ballistic barrier according to claim 6, wherein said at least one furniture unit also includes at least two spaced apart side elements extending between the top and the base and the at least one handle is formed in or attached to at least one of the side elements.

8. An anti-ballistic barrier according to claim 1, further including at least two furniture units wherein in the utility position, each of the at least two furniture units are located on laterally opposite sides of an opening, the furniture units being moved together to cooperative act as a barrier across the opening when moved into the defence position.

9. An anti-ballistic barrier according to claim 1, wherein said at least one furniture unit includes a furniture unit fastening arrangement to interconnect adjacent furniture units.

10. An anti-ballistic barrier according to claim 1, wherein said at least one furniture unit also includes at least two spaced apart side elements, the side elements extending between the top and the base, the anti-ballistic arrangement being configured having at least a portion extending between the top, the base and each side element of the furniture unit and wherein the anti-ballistic arrangement includes at least one antiballistic panel substantially extending the area between the top, the base and the side panels.

11. An anti-ballistic barrier according to claim 10, wherein the anti-ballistic arrangement includes at least one antiballistic panel substantially extending parallel, and substantially adjacent, to the side panels.

12. An anti-ballistic barrier according to claim 1, further including a back element located between the top and the base, wherein the back element includes a recess configured to receive a door handle or other actuator.

13. An anti-ballistic barrier according to claim 1, wherein the antiballistic arrangement is centrally mounted on the mobility arrangement.

14. An anti-ballistic barrier according to claim 1, wherein the antiballistic arrangement extends from a top of the furniture unit to a proximate ground engaging position.

15. An anti-ballistic barrier according to claim 1, wherein the anti-ballistic material comprises at least one soft armour material, at least one hard armour material or a combination thereof.

16. An anti-ballistic barrier according to claim 1, further including a base fastening arrangement for securing the furniture unit in position in one or both of the utility position or the defence position wherein the base fastening arrangement comprises at least one latch which is releasably engageable with a receiving formation mounted in a fixed position in one or both of the utility position or the defence position.

17. An anti-ballistic barrier according to claim 16, wherein the latch is located in the base of the furniture unit and the receiving formation is fixed to a ground location in the utility position and/or the defence position.

18. An anti-ballistic barrier according to claim 1, comprising a storage unit and further including at least one shelf element on which objects can be stored within the furniture unit.

19. An anti-ballistic barrier according to claim 18, wherein the furniture unit comprises at least one of a shelving unit or a cupboard.

* * * * *